US005921097A

United States Patent [19]

Galbreath, Sr.

[11] Patent Number: 5,921,097

[45] Date of Patent: Jul. 13, 1999

[54] PURGE PROCESSOR

[76] Inventor: Charles E. Galbreath, Sr., P.O. Box 507, Westlake, La. 70669

[21] Appl. No.: 08/765,277

[22] PCT Filed: Sep. 27, 1996

[86] PCT No.: PCT/US96/15483

§ 371 Date: Dec. 20, 1996

§ 102(e) Date: Dec. 20, 1996

[87] PCT Pub. No.: WO98/13654

PCT Pub. Date: Apr. 2, 1998

[51] Int. Cl.[6] ..... F25B 43/04

[52] U.S. Cl. ..... 62/195; 62/475

[58] Field of Search ..... 62/85, 149, 195, 62/475, 292

[56] References Cited

U.S. PATENT DOCUMENTS

| | | | |
|---|---|---|---|
| 3,478,529 | 11/1969 | Boykin | 62/475 |
| 4,304,102 | 12/1981 | Gray | 62/195 |
| 4,646,527 | 3/1987 | Taylor | 62/85 |
| 5,241,837 | 9/1993 | Albertson, III | 62/475 |
| 5,313,805 | 5/1994 | Blackmon et al. | 62/195 |
| 5,355,685 | 10/1994 | Stie et al. | 62/85 |
| 5,367,886 | 11/1994 | Manz et al. | 62/195 |
| 5,388,416 | 2/1995 | Manz et al. | 62/85 |
| 5,465,590 | 11/1995 | Van Steenburgh, Jr. | 62/195 |

FOREIGN PATENT DOCUMENTS

| | | | |
|---|---|---|---|
| 3-95370 | 4/1991 | Japan | 62/195 |
| 4-316973 | 11/1992 | Japan | 62/195 |
| 1041833 | 9/1983 | U.S.S.R. | 62/85 |

*Primary Examiner*—William Doerrler
*Attorney, Agent, or Firm*—Richard C. Litman

[57] ABSTRACT

A purge processor for purging air and other noncondensibles from refrigeration systems or refrigeration handling systems includes: an inlet gas connector for receiving a gaseous mixture of noncondensibles and refrigerant; a first and second refrigerant receiver; a compressor; a condenser; and a differential pressure switch connected to a solenoid valve for automatically purging a predetermined percentage by volume of refrigerant. For low pressure refrigerant, a back pressure regulator maintains the second refrigerant receiver at a colder temperature than the first. For high pressure refrigerant, an additional compressor and condenser maintains the second refrigerant receiver at a colder temperature than the first. The present invention can continuously separate refrigerant and automatically purge an exhaust known to have less than 1% by volume of refrigerant.

15 Claims, 3 Drawing Sheets

PURGE PROCESSOR

CROSS REFERENCE TO RELATED APPLICATIONS

The present application claims the priority benefit of the Patent Cooperation Treaty (PCT) application Serial No. US 96/15483 filed on Sep. 27, 1996.

BACKGROUND OF THE INVENTION

1. Field of the Invention

The present invention relates generally to a refrigeration purging system and more particularly to purge processors for low or high pressure refrigerant.

2. Description of Prior Art

Refrigerant tends to be expensive, as well as damaging to the environment. In the past, however, refrigerant containing chlorofluoronated carbons (CFC's) or halogenated chlorofluoronated carbons (HCFC's) was not so costly. As such, repairmen working on air conditioning or refrigeration systems would release refrigerant containing CFC's and HCFC's into the atmosphere and simply recharge the systems with new. Once the adverse impact such discharges had on the ozone layer became known, many governments began to prohibit the manufacture of CFC's and HCFC's.

In such an artificially inflated marketplace, refrigerant handling systems capable of recycling and/or reclaiming refrigerant became desirable. Most recycling machines have been equipped with air purge devices which vent air and other noncondensible contaminants from the refrigerant. Due to the fact that some refrigerant will mix with the air and noncondensibles, undesirable quantities of refrigerant are still being released into the atmosphere when purging occurs.

Within the United States, the quantity of refrigerant which can be purged into the atmosphere has been limited to no more than three percent by volume, according to The Clean Air Act, Section III, Sub-part e. Many attempts have been made to limit the quantity of refrigerant purged into the atmosphere during recycling and/or reclaim operations.

Examples of these attempts include U.S. Pat. No. 4,304,102 issued Dec. 8, 1981 to Gray; U.S. Pat. No. 5,241,837 issued Sep. 7, 1993 to Albertson, III; U.S. Pat. No. 5,355,685 issued Oct. 18, 1994 to Stie et al.; U.S. Pat. No. 5,367,886 issued Nov. 29, 1994 to Manz et al.; U.S. Pat. No. 5,338,416 issued Feb. 14, 1995 to Manz et al.; and U.S. Pat. No. 5,465,590 issued Nov. 14, 1995 to Van Steenburgh, Jr. et al.

Gray discloses a condenser with a float chamber, an evaporator, a compressor, a pair of purge chambers for purging the noncondensibles mixed with the refrigerant within the condenser, and a control system. The control system includes a differential pressure switch which measures the pressure drop across an orifice between the first purge chamber and a line ahead of the orifice. The differential pressure switch energizes a pump which circulates the gaseous mixture from the first to the second purge chamber. The pump also increases the pressure in the second purge chamber to aid in condensation.

Albertson, III discloses an auxiliary purge unit to be retrofitted to an existing purge unit of a low pressure refrigeration system. The auxiliary purge unit includes a condenser; compressor; evaporator; pneumatic chamber; discharge tank; and a double-walled condenser portion having a chilled condensing coil, a stand pipe, and an exhaust port. Albertson, III does not suggest when the noncondensible gases are to be purged from the exhaust port.

Stie et al. discloses a method of operating a purge system for a closed loop refrigeration unit with the aid of a programmable controller. The controller purges noncondensible gases once a difference between the actual and known vapor pressures of the refrigerant is greater than a desired value.

Manz et al. '886 and '416 disclose a refrigerant handling system and method with air purge and system clearing capabilities. The disclosure includes a pump which directs refrigerant through a condenser and into an air purge chamber. Air and other noncondensibles are purged, either manually or automatically, through a purge valve. A gauge serves in the determination of when such noncondensibles are to be purged.

Van Steenburgh, Jr. et al. discloses an air purge device including an evaporator contained within a chill chamber, a capillary tube, a filter drier, a solenoid valve, an insulated evaporator enclosure, a purge valve, and auxiliary devices. The disclosed device purges when a temperature differential between the side of the chill chamber and the evaporator outlet gradually increased, in lieu of using a "single shot" timer.

Other relevant patents include Japanese Publication Nos. 3-95370 on Apr. 19, 1991; and 4-316973 on Nov. 9, 1992; and Soviet Union No. 1041833 of Sep. 15, 1983.

None of the above inventions and patents, taken either singularly or in combination, is seen to describe the present invention as claimed. Thus a purge processor solving the aforementioned problems is desired.

SUMMARY OF THE INVENTION

In the present invention, an inlet gas connector for receiving a gaseous mixture of noncondensibles and refrigerant is in fluid communication with a first refrigerant receiver having a condensing coil. A portion of the refrigerant contained within the gaseous mixture condenses due to the condensing coil. Remaining noncondensibles and refrigerant pass through a restrictive orifice to a second refrigerant receiver having a condensing coil.

One embodiment of the present invention, relative to low pressure refrigerant, includes a back pressure regulator connected to a compressor for maintaining a colder temperature within the second refrigerant receiver compared to the first. Another embodiment of the present invention, relative to high pressure refrigerant, includes having two compressors and condensers for maintaining a colder temperature within the second refrigerant receiver compared to the first.

Both embodiments have a differential pressure switch in communication with a solenoid valve for automatically releasing air and other noncondensibles into the atmosphere. The differential pressure switch measures the change in pressure between the first and second refrigerant receivers. Because the second receiver is colder than the first, changes in pressure are measurably attributable to air and other noncondensibles trapped in the second refrigerant receiver. As such, air and other noncondensibles are continually separated from low or high pressure refrigerants and automatically purged with a predetermined percentage by volume of refrigerant.

Accordingly, it is a principal object of the invention to separate and purge air and other noncondensible contaminant from refrigerant with a purge loss limit of three percent by volume refrigerant.

It is another object of the invention to automatically purge a gaseous mixture of air and other noncondensible contaminants known to contain a specific percent by volume of refrigerant.

It is a further object of the invention to continuously recycle and monitor low or high pressure refrigerant.

It is also an object of the invention to provide improved elements and arrangements thereof in a purge processor for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
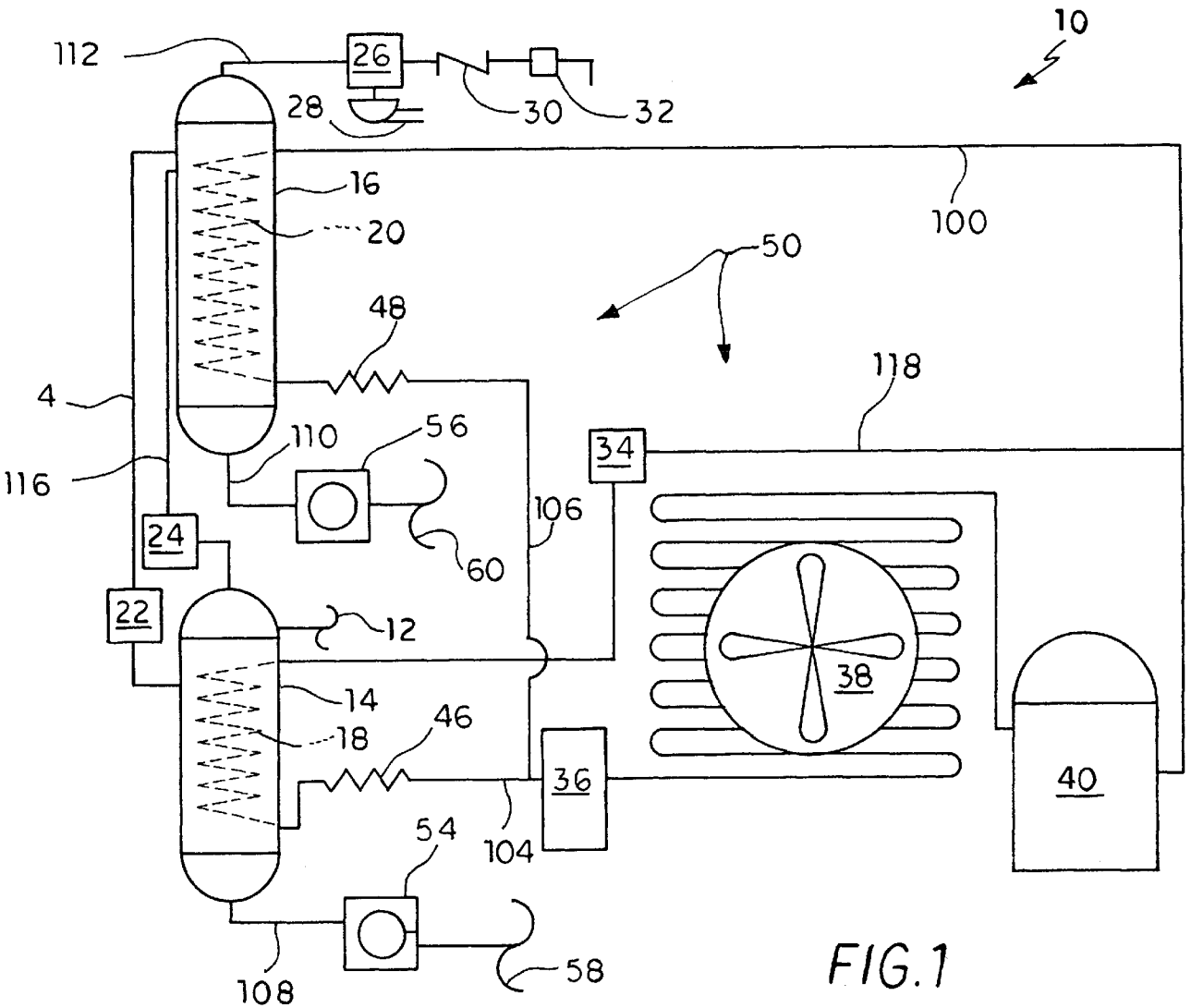
FIG. 1 is a schematic diagram of a purge processor according to the present invention for use with low pressure refrigerant.
Figure 2A:
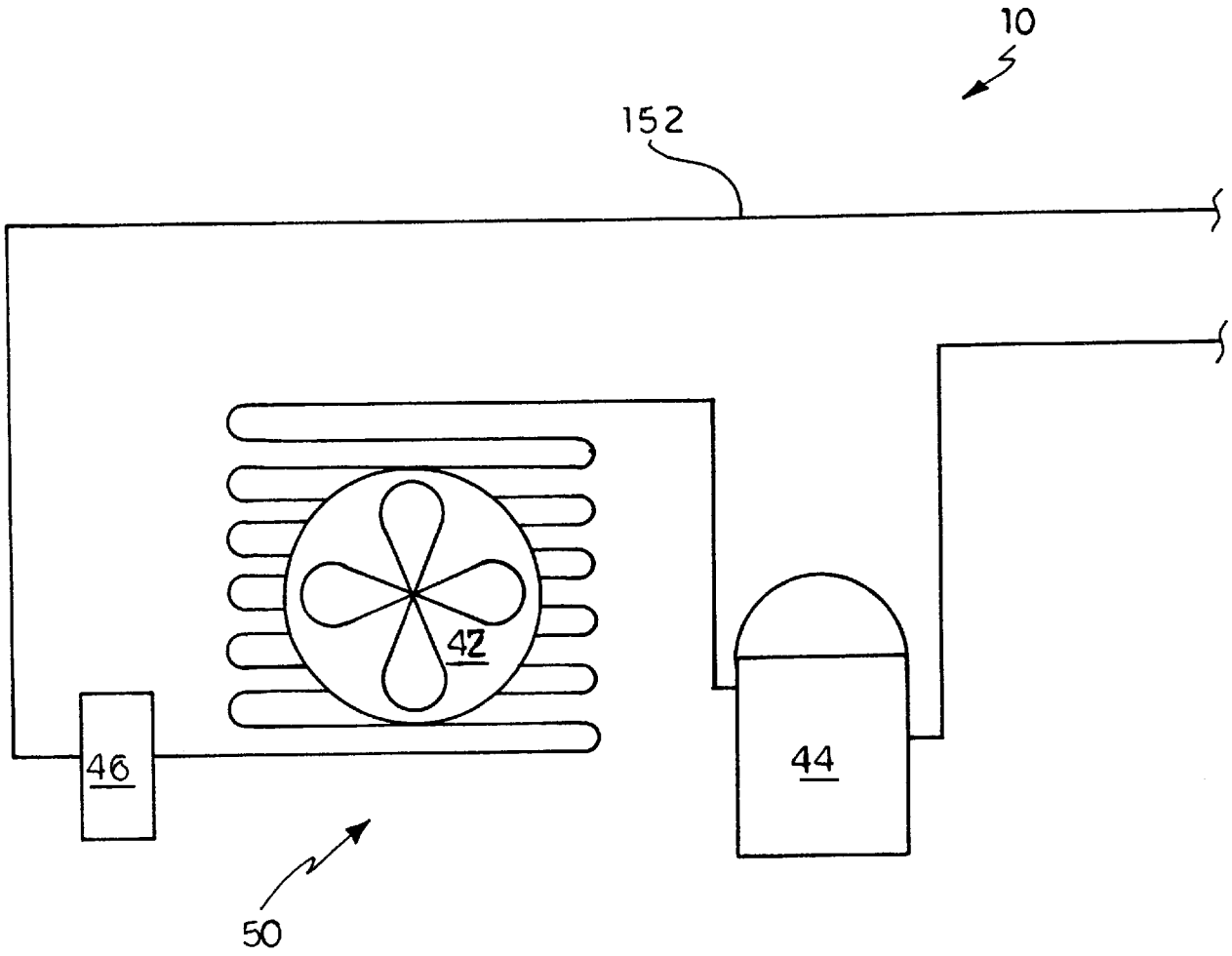
FIGS. 2A and 2B cooperatively show a schematic diagram of a purge processor according to the present invention for use with high pressure refrigerant.
Figure 2B:
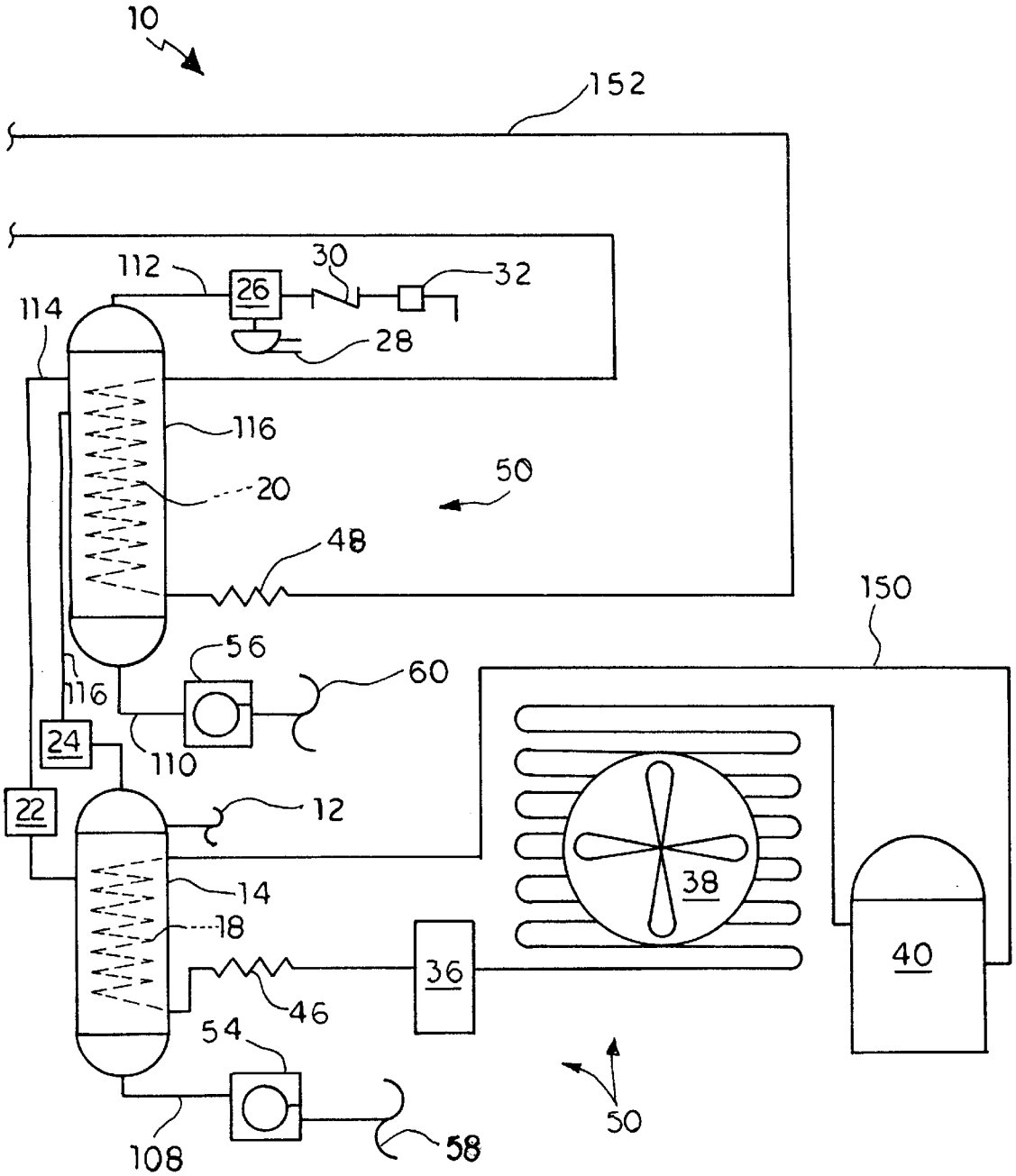

As seen in FIGS. 1, 2A and 2B, the present invention is a purge processor 10 for separating and purging air and other noncondensibles from refrigerant contained within refrigeration systems or refrigeration handling systems. The purge processor 10 includes an inlet gas connector 12 for receiving a gaseous mixture of noncondensibles and refrigerant, a first refrigerant receiver 14 having a condensing coil 18, and a second refrigerant receiver 16 having a condensing coil 20.

Referring to FIG. 1, one embodiment of the present invention is a purge processor 10 for use with a refrigeration system or a refrigeration handling system containing low pressure refrigerant. Low pressure refrigerant is that refrigerant which commonly condenses at fifty pounds per square inch gage (PSIG) and has a high boiling point. With respect to purge processor 10 shown in FIG. 1, low pressure refrigerant is refrigerant that would normally operate in a vacuum at operating temperatures and not exceed 40 PSIG at condensing temperatures.

As shown in FIG. 1, cooling means 50 includes a compressor 40 in fluid communication with the second condensing coil 20, and a condenser 38 in fluid communication with the compressor 40 via conduit 100. A third refrigerant receiver 36 is in fluid communication with the condenser 38 via conduit 102. Conduit 102 interlinks conduits 104 and 106. Along conduit 104, a first capillary metering device 46 is in fluid communication with the third refrigerant receiver 36 and the first condensing coil 18. Along conduit 106, a second capillary metering device 48 is in fluid communication with the third refrigerant receiver 36 and the second condensing coil 20. Temperature maintenance means 34 is in fluid communication with the compressor 40 and the second condensing coil 18 via conduits 118, 100. Temperature maintenance means 34 is a back pressure regulator.

Referring to FIGS. 2A and 2B, another embodiment of the present invention is a purge processor for use with a refrigeration system or a refrigeration handling system containing high pressure refrigerant. High pressure refrigerant is that refrigerant which commonly condenses at 300 PSIG and has a low boiling point.

As shown in FIGS. 2A and 2B, cooling means 50 includes a compressor 40 in fluid communication with the first condensing coil 18, and a condenser 38 in fluid communication with the compressor 40 via conduit 150. A third refrigerant receiver 36 is in fluid communication with the condenser 38 via conduit 150. Along conduit 150, a first capillary metering device 46 is in fluid communication with the third refrigerant receiver 36 and the first condensing coil 18. Similarly, a compressor 44 is in fluid communication with the second condensing coil 20, while a condenser 42 is in fluid communication with the compressor 44 via conduit 152. A fourth refrigerant receiver 46 is in fluid communication with the condenser 42 via conduit 152. Along conduit 152, a second capillary metering device 48 is in fluid communication with the fourth refrigerant receiver 46 and the second condensing coil 20. First and second capillary metering devices 46, 48 can be expansion valves or capillary tubing.

Referring to FIGS. 1, 2A and 2B, each embodiment of the purge processor 10 has a differential pressure switch 22 in fluid communication with the first and second refrigerant receivers 14, 16 via conduit 114. The differential pressure switch 22 has a low and a high setting. Furthermore, each embodiment has a first restrictive orifice 24 interconnected among first and second refrigerant receivers 14, 16 via conduit 116. Each embodiment has a first float drainer 54 in fluid communication with the first refrigerant receiver 14, and a first liquid refrigerant outlet connector 58 in fluid communication with the first float drainer 54 via conduit 108. Similarly, each embodiment has a second float drainer 56 in fluid communication with the second refrigerant receiver 16, and a second liquid refrigerant outlet connector 60 in fluid communication with the second float drainer 54 via conduit 110.

Each embodiment of the purge processor 10 has an automatic purging means 66 in fluid communication with the second refrigerant receivers 16 via conduit 112. Automatic purging means 66 includes a solenoid valve 26, a valve 30, and a second restrictive orifice 32 in fluid communication with the second refrigerant receiver 16 via conduit 112. The solenoid valve 26 has an electrical coil 28, partially shown, which is in communication with the differential pressure switch 22. Valve 30 is a check valve for preventing air from entering into the second restrictive orifice 32. The above-mentioned devices are conventional and well known in the art.

In operation, the inlet gas connector 12 is connected to the refrigerant line of a refrigeration system, or alternatively, a purge outlet valve of a refrigeration handling system. The purge processor 10, while limited to receiving a gaseous mixture, need not be limited to only cleaned and dried vapor. As such, the present invention may be joined directly to a refrigeration system in order to continuously monitor and recycle the refrigerant passing therethrough.

If the refrigerant contained within refrigeration system or refrigeration handling system is low pressure refrigerant, the embodiment shown in FIG. 1 should be employed. Conversely, if the refrigerant contained within the refrigeration system or refrigeration handling system is high pressure refrigerant, the embodiment shown in FIGS. 2A and 2B should be employed. Whether low or high pressure refrigerant, these embodiments can be used on many types of refrigerant including ammonia, propane, and other similar refrigerant used in process plants.

Once the inlet gas connector 12 of the appropriate embodiment is receiving a gaseous mixture of refrigerant, air and other noncondensibles, the purge processor 10 will continually monitor the gaseous mixture until a predetermined percentage by volume of refrigerant. As such, the gaseous mixture enters through connector 12 and into the first refrigerant receiver 14. Because the first refrigerant receiver 14 has been chilled by the first condensing coil 18, a major portion of the refrigerant is condensed when it comes into contact with the refrigerated interior surface of the receiver 14. That refrigerant which has condensed will fall down the sides of the receiver 14, entering the first float drainer 54. Once enough liquid refrigerant has entered the float drainer 54, refrigerant will drain back into the refrigerant system or refrigerant handling system via first liquid drain connector 58.

While the great majority of refrigerant entering through connector 12 condenses, a portion of vaporous refrigerant mixes with air and other noncondensibles and accumulates at the top of receiver 14. This vaporous mixtures passes through the first restrictive orifice 24 into the second refrigerant receiver 16. The size of the restrictive orifice 24 varies depending on the type of refrigerant used. A properly dimensioned orifice 24 will regulate the volume of the vaporous mixture entering into the second refrigerant receiver 16 without dramatically affecting the temperature and pressure within the receiver 16.

The refrigerant contained within the gaseous mixture entering into the second receiver 16 will condense and drain into the second fluid drainer 56 similar to that with the first receiver 14. However, the second receiver 16 must be maintained at a much lower temperature than the first 14 in order to assure that the remaining refrigerant will condense. This is accomplished differently, depending on the embodiment employed.

With respect to the low pressure purge processor 10, a back pressure regulator 34 is incorporated on conduit 118 between the first condensing coil 18 and the inlet connection to the compressor 40. The back pressure regulator 34 is set to establish a temperature that is above freezing water. Because the second condensing coil 20 has an unregulated suction, the interior of the second receiver 16 is allowed to go to a much lower temperature. More particularly, the regulator 34 maintains a constant pressure on the upper side of the regulator valve 34 and thus creates a higher constant temperature within the first refrigerant receiver 14.

With respect to the high pressure purge processor 10, the additional compressor 44 and condenser 42 incorporated via conduit 152 into the second condensing coil 20 is capable of producing a very low temperature within the second refrigerant receiver 16. Typically, the low temperature area is maintained at −50 degrees Fahrenheit.

As the second refrigerant receiver 16 is able to condense more refrigerant, the pressure within this receiver 16 should be much lower than in the first refrigerant receiver 14. When more and more noncondensibles enter into the second refrigerant receiver 16, less condensation will occur and the pressure within the second refrigerant receiver 16 will approach that of the first refrigerant receiver 14. The differential pressure switch 22 measures the change in pressure between the first and second receivers 14, 16 via conduit 114.

The differential pressure switch 22 has a low and a high setting. The purge process cycle will be continuous when the change in pressure is within a preset differential which must be calculated for the particular refrigerant and application. Typically, the low setting is preset at between 1 to 6 pounds per square inch gage differential and the high setting is preset at between 8 to 25 pounds per square inch gage differential. The purge process will cease to be continuous when the differential pressure switch 22 reaches the low setting, completing the electrical circuit between the electrical coil 28 of the solenoid valve 26 and the differential pressure switch 22 and energizing the solenoid valve 26. Once energized, the solenoid valve 26 opens, allowing air and other noncondensibles which have been accumulating at the top of the second receiver 16 to be released into the atmosphere via check valve 30 and second restrictive orifice 32. The check valve 26 prevents any air from entering through the second restrictive orifice 32.

The differential pressure switch 22 will automatically cease to energize the solenoid valve 26 in the open position once the change in pressure reaches the high setting. In general, if the user sets the low and high settings at relatively small values with a relatively small differential between the two, such as 4 and 8 pounds per square inch differential, respectively, a lesser volume of refrigerant will be purged into the atmosphere. Both embodiments are capable of continuously separating refrigerant and automatically purging an exhaust known to have less than 1% by volume of refrigerant.

It is to be understood that the present invention is not limited to the embodiments described above, but encompasses any and all embodiments within the scope of the following claims.

I claim:

1. A purge processor for purging noncondensibles from refrigeration systems or refrigeration handling systems, said purge processor comprising:

an inlet gas connector for receiving a gaseous mixture of noncondensibles and refrigerant;

a first refrigerant receiver in fluid communication with said inlet gas connector, said first receiver having a first condensing coil disposed therewithin;

a second refrigerant receiver in fluid communication with said first refrigerant receiver, said second refrigerant receiver having a second condensing coil disposed therewithin;

a cooling means for cooling said first and second condensing coils, said cooling means in fluid communication with said first and second condensing coils;

a differential pressure switch for measuring a change in pressure between said first and second refrigerant receivers, said differential pressure switch in fluid communication with said first and second refrigerant receivers;

a first float drainer in fluid communication with said first refrigerant receiver;

a first liquid refrigerant outlet connector in fluid communication with said first float drainer;

a second float drainer in fluid communication with said second refrigerant receiver;

a second liquid refrigerant outlet connector in fluid communication with said second float drainer; and an automatic purging means for automatically purging noncondensibles when said differential pressure switch indicates that a predetermined change in pressure exists between said first and second refrigerant receivers, said automatic purging means in fluid communication with said second refrigerant receiver and in communication with said differential pressure switch, whereby noncondensibles are continually separated from a refrigerant and automatically purged with a predetermined percentage by volume of refrigerant.

2. The purge processor as defined in claim 1 wherein said cooling means includes a condenser in fluid communication with said compressor;

a third refrigerant receiver in fluid communication with said compressor;

a first capillary metering device in fluid communication with said third refrigerant receiver and said first condensing coil; and a second capillary metering device in fluid communication with said third refrigerant receiver and said second condensing coil, whereby said inlet gas connector receives a gaseous mixture of noncondensibles and a low pressure refrigerant that will condense at 40 PSIG or less.

3. The purge processor as defined in claim 2, further comprising a back pressure regulator for maintaining said first condensing coil at a lower temperature than said second condensing coil, said back pressure regulator in fluid communication with said compressor and said first condensing coil.

4. The purge processor as defined in claim 1 wherein said cooling means includes a first compressor in fluid communication with said first condensing coil;

a second compressor in fluid communication with said second condensing coil;

a first condenser in fluid communication with said first compressor;

a second condenser in fluid communication with said second compressor;

a third refrigerant receiver in fluid communication with said first condenser;

a fourth refrigerant receiver in fluid communication with said second condenser;

a first capillary metering device in fluid communication with said third refrigerant receiver and said first condensing coil; and a second capillary metering device in fluid communication with said fourth refrigerant receiver and said second condensing coil, whereby said inlet gas connector receives a gaseous mixture of noncondensibles and a high pressure refrigerant that will condense at 300 PSIG or less.

5. The purge processor as defined in claim 3 wherein said automatic purging means includes a solenoid valve in fluid communication with said second refrigerant receiver, said solenoid valve having an electrical coil in communication with said differential pressure switch;

a valve in fluid communication with said solenoid valve; and a second restrictive orifice in fluid communication with said valve.

6. The purge processor as defined in claim 5 wherein said solenoid valve in fluid communication with said solenoid valve is a check valve for preventing air from entering into said second restrictive orifice.

7. The purge processor as defined in claim 4 wherein said automatic purging means includes a solenoid valve in fluid communication with said second refrigerant receiver, said solenoid valve having an electrical coil in communication with said purity sensor means;

a valve in fluid communication with said solenoid valve; and a second restrictive orifice in fluid communication with said valve.

8. The purge processor as defined in claim 7 wherein said valve in fluid communication with said solenoid valve is a check valve for preventing air from entering into said second restrictive orifice.

9. A purge processor for use with a refrigeration system or a refrigeration handling system containing low pressure refrigerant, said purge processor comprising:

an inlet gas connector for receiving a gaseous mixture of noncondensibles and a low pressure refrigerant that will condense at 40 PSIG or less;

a first refrigerant receiver in fluid communication with said inlet gas connector, said first receiver having a first condensing coil disposed therewithin;

a second refrigerant receiver in fluid communication with said first refrigerant receiver, said second refrigerant receiver having a second condensing coil disposed therewithin;

a differential pressure switch in fluid communication with said first and second refrigerant receivers, said differential pressure switch for measuring a change in pressure between said first and second refrigerant receivers;

a first restrictive orifice in fluid communication with said first refrigerant receiver;

a compressor in fluid communication with said second condensing coil;

a condenser in fluid communication with said compressor;

a third refrigerant receiver in fluid communication with said condenser;

a first capillary metering device in fluid communication with said third refrigerant receiver and said first condensing coil;

a second capillary metering device in fluid communication with said third refrigerant receiver and said second condensing coil;

a solenoid valve in fluid communication with said second refrigerant receiver, said solenoid valve having an electrical coil in communication with said differential pressure switch, said differential pressure switch energizing said solenoid valve when a predetermined change in pressure exists between said first and second refrigerant receivers;

a valve in fluid communication with said solenoid valve; and a second restrictive orifice in fluid communication with said valve, whereby air and other noncondensibles are continually separated from a low pressure refrigerant and automatically purged with a predetermined percentage by volume of refrigerant.

10. The purge processor as defined in claim 9, further comprising:

a first float drainer in fluid communication with said first refrigerant receiver;

a first liquid refrigerant outlet connector in fluid communication with said first float drainer;

a second float drainer in fluid communication with said second refrigerant receiver; and a second liquid refrigerant outlet connector in fluid communication with said second float drainer, whereby condensed refrigerant enters through said first and second float drainers and exits out said first and second liquid refrigerant outlet connectors, respectively.

11. The purge processor as defined in claim 10 further comprising a back pressure regulator in fluid communication with said compressor and said first condensing coil, whereby said first condensing coil has a lower temperature than said second condensing coil.

12. The purge processor as defined in claim 11 wherein said valve in fluid communication with said solenoid valve is a check valve for preventing air from entering into said second restrictive orifice.

13. A purge processor for use with a refrigeration system or a refrigeration handling system containing high pressure refrigerant, said purge processor comprising:

an inlet gas connector for receiving a gaseous mixture of noncondensibles and a high pressure refrigerant that will condense at 300 PSIG or less;

a first refrigerant receiver in fluid communication with said inlet gas connector, said first receiver having a first condensing coil disposed therewithin;

a second refrigerant receiver in fluid communication with said first refrigerant receiver, said second refrigerant receiver having a second condensing coil disposed therewithin;

a differential pressure switch in fluid communication with said first and second refrigerant receivers, said differential pressure switch for measuring a change in pressure between said first and second refrigerant receivers;

a first restrictive orifice in fluid communication with said first refrigerant receiver;

a first compressor in fluid communication with said first condensing coil;

a second compressor in fluid communication with said second condensing coil;

a first condenser in fluid communication with said first compressor;

a second condenser in fluid communication with said second compressor;

a third refrigerant receiver in fluid communication with said first condenser;

a fourth refrigerant receiver in fluid communication with said second condenser;

a first capillary metering device in fluid communication with said third refrigerant receiver and said first condensing coil;

a second capillary metering device in fluid communication with said fourth refrigerant receiver and said second condensing coil;

a solenoid valve in fluid communication with said second refrigerant receiver, said solenoid valve having an electrical coil in communication with said differential pressure switch, said differential pressure switch energizing said solenoid valve when a predetermined change in pressure exists between said first and second refrigerant receivers;

a valve in fluid communication with said solenoid valve; and a second restrictive orifice in fluid communication with said valve, whereby air and other noncondensibles are continually separated from a high pressure refrigerant and automatically purged with a predetermined percentage by volume of refrigerant.

14. The purge processor as defined in claim 13, further comprising:

a first float drainer in fluid communication with said first refrigerant receiver;

a first liquid refrigerant outlet connector in fluid communication with said first float drainer;

a second float drainer in fluid communication with said second refrigerant receiver; and a second liquid refrigerant outlet connector in fluid communication with said second float drainer, whereby condensed refrigerant enters through said first and second float drainers and exits out said first and second liquid refrigerant outlet connectors, respectively.

15. The purge processor as defined in claim 14 wherein said valve in fluid communication with said solenoid valve is a check valve for preventing air from entering into said second restrictive orifice.

* * * * *